United States Patent [19]

Troncoso

[11] Patent Number: 4,612,906

[45] Date of Patent: Sep. 23, 1986

[54] COMPOUND ARCHERY BOW ASSEMBLY

[76] Inventor: Vincent F. Troncoso, 14090-6100 Rd., Montrose, Colo. 81401

[21] Appl. No.: 688,818

[22] Filed: Jan. 4, 1985

[51] Int. Cl.[4] ..... F41B 5/00

[52] U.S. Cl. ..... 124/24 R; 124/DIG. 1; 124/86

[58] Field of Search ..... 124/23 R, 24 R, 86, 124/88, 90, DIG. 1, 41 A

[56] References Cited

U.S. PATENT DOCUMENTS

| | | | |
|---|---|---|---|
| 3,499,414 | 3/1970 | Frydenlund | 124/41 A |
| 3,867,920 | 2/1975 | Westphal | 124/86 |
| 4,421,093 | 12/1983 | Stock | 124/86 |

OTHER PUBLICATIONS

Richmond Sports, Cricket Compound Clicker, Archery, Jun. 1978, p. 6.

*Primary Examiner*—Richard C. Pinkham
*Assistant Examiner*—Benjamin Layno
*Attorney, Agent, or Firm*—Donald E. Nist

[57] ABSTRACT

The improved assembly comprises a compound archery bow having a pair of spaced bow limbs, a handle with arrow rest, pulleys connected to the limbs, first and second pulley cables and a bowstring connected to the cables. A novel drawcheck is connected to the cables out of the path of an arrow when placed on the rest. The drawcheck includes an indicator component releasably secured to one of the cables and which comprises a flexible clicker blade or a light assembly with a switch arm disposed in the path of travel of an activator component secured to a second adjacent cable. The latter comprises a protuberance, such as a bead, block, cylinder or the like. The activator and indicator components travel with their respective cables toward each other as the bowstring is drawn, and contact each other to activate the indicator component and generate a signal when the bowstring is at full draw. Thus, a light is turned on or an audible click is made by the indicator blade on a tympanum near thereto to signal full draw. Arrow deflection by the clicker is thus totally avoided. The drawcheck is located in a protected area on the bow and is fully adjustable. The assembly provides improved shooting performance.

8 Claims, 4 Drawing Figures

COMPOUND ARCHERY BOW ASSEMBLY

BACKGROUND OF THE INVENTION

1. Field of the Invention

The present invention generally relates to archery equipment and more particularly to an improved compound archery assembly with novel drawcheck.

2. Prior Art

Various so-called compound archery bows have become very popular because they provide gradual arrow acceleration and thus less arrow bending, thereby improving arrow speed and accuracy. Moreover, compound bows generally provide a mechanical advantage over conventional non-compound recurve bows, and allow the archer to hold at full draw at a lower draw weight than the maximum draw weight encountered during the draw. This also promotes improved shooting accuracy.

Most archers use drawchecks, usually of the audible clicker type, to indicate when they have reached full bowstring draw and thus enable them to have the bowstring apply the same propelling force to the arrow each time, thereby improving shooting accuracy. The drawchecks are usually secured to the arrow window in the bow handle section, and the arrow is fed between the flexible drawcheck blade and the bow sidewall defining the side of the window, holding the drawcheck blade in the flexed position away from the bow sidewall. When the arrow is drawn by the bowstring to full draw, its point just clears the rear of the drawcheck blade, which then springs against the bow sidewall and clicks, signalling time for the release of the bowstring, and the archer fires automatically. Unfortunately, the drawcheck blade biases the arrow sideways under its spring tension until the blade is cleared, at which time the arrow tends to spring slightly laterally of the bow, shooting somewhat erratically and inaccurately, depending on the amount of time between the click and the bowstring release. This lateral spring is accentuated if the arrow while on the rest is, as is usually the case, spaced from the bow sidewall by a spring biased plunger. Accordingly, there is a need for an improved type of drawcheck which will not exert tension on the arrow and cause shooting inaccuracy.

Conventional clicker type drawchecks are usually pasted in a fixed position on the bow sidewall and are difficult to peel off and relocate in order to adjust the draw length. Such adjustment is necessary when different arrow lengths are used to fit different circumstances. Moreover such drawchecks are in a somewhat exposed position on the bow and can snag and become bent during transport and use of the bow, adversely affecting the operation and accuracy of the drawcheck.

There is a need for an improved drawcheck which will not snag, become bent and out of alignment and which can be easily and accurately adjusted to suit various draw lengths.

SUMMARY OF THE INVENTION

The improved compound archery bow assembly of the present invention satisfies all the foregoing needs. The assembly is substantially set forth in the Abstract above. Thus, it comprises a compound bow which includes an improved drawcheck which is completely out of contact with the arrow and the arrow path and therefore cannot interfere with its accurate flight. Moreover, the drawcheck is positionable well above or below the arrow rest in a protected area defined by the bow limb and pulley cables, so that it cannot snag or become bent or misaligned.

The drawcheck is fully adjustable and repositionable and includes an indicator component connected to one of the bow's pulley cables and extending into the path traveled by an activator component fixed to another one of the pulley cables.

As the bowstring is drawn, the pulley cables move such that the indicator component and activator component travel toward each other. Both of these components are positioned on their respective cables so that the activator component contacts and activates the indicator when the archer is at a preselected full draw. The indicator component signals this with an audible click, preferably against a tympanum, or by a light coming on, such as may be part of the indicator component. In order to adjust the full draw position, at least one of the indicator and activator components is adjustable in position. Thus, for example, the indicator component can have a clicker blade which is adjustable in length. Moreover, the indicator component can be releasably secured to its cable by a set screw. The activator component can have a block adjustably secured around the cable by a set screw, and/or have peelable or frangible segments to control its length and position.

Various other features of the present invention are set forth in the following detailed description and accompanying drawings.

DRAWINGS

DETAILED DESCRIPTION

FIGS. 1–2.

Figure 1:
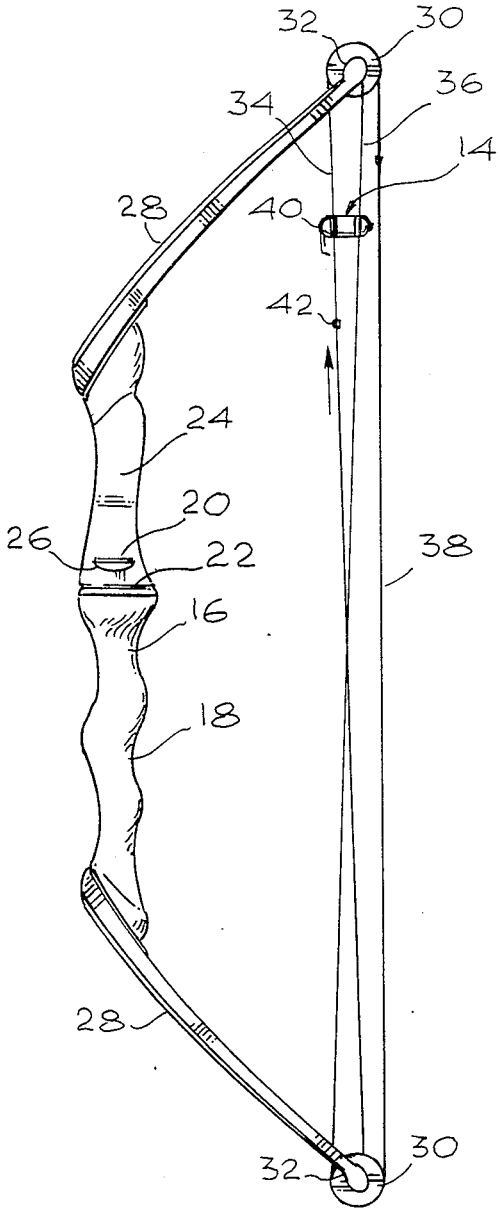
FIG. 1 is a schematic side elevation of a preferred embodiment of the improved compound archery bow assembly of the present invention.
Figure 2:
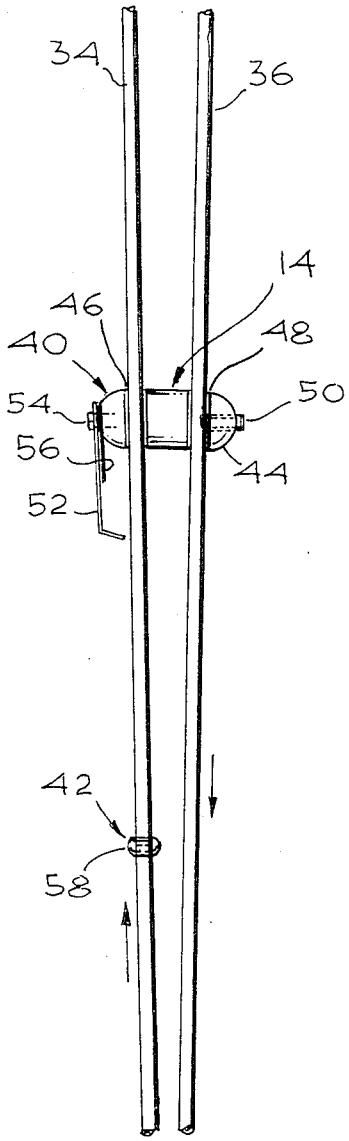
FIG. 2 is an enlarged schematic fragmentary side elevation of the drawcheck portion of the assembly of FIG. 1.

Now referring More particularly to FIGS. 1 and 2 of the drawings, a preferred embodiment of the improved compound archery bow assembly of the present invention is schematically depicted therein. Thus, assembly 10 is shown which comprises a conventional compound archery bow 12.

Bow 12 may be in any suitable form. In this instance, it comprises a central metal or wood bow handle section 16 bearing a hand grip area 18 and an arrow window 20 defined by a horizontal shelf 22 and vertical sidewall 24. An arrow rest 26 is secured to sidewall 24 and extends into window 20 above shelf 22. Bow 12 also includes a pair of laminated composite bow limbs 28 secured to opposite ends of section 16 and each rotatably bearing a cable wheel 30 at the tip 32 thereof.

Pulley cables 34 and 36 are trained around wheels 30 to provide bow 12 with a mechanical advantage, and span the length of bow 12. A bowstring 38 is secured to cables 34 and 36 adjacent tips 32, along about the longitudinal centerline thereof and is generally parallel to and spaced slightly laterally from cables 34 and 36.

Drawcheck 14 comprises an indicator component 40 adjustably secured to cable 36 and an activator portion 42 fixedly secured to cable 34. Indicator component 40 comprises an elongated casing 44 having a pair of grooves or passageways 46 and 48 extending therethrough and slideably receiving cables 34 and 36. Thus, casing 44 spans cables 34 and 36 adjacent limb tip 32 and is releasably secured to cable 36 by a set screw 50 pinning cable 36 in groove 48. Component 40 also includes a flexible resilient blade 52 of metal or the like adjustably secured to casing 44 by set screw 54, and a tympanum plate 56 positioned directly behind blade 52 and secured to casing 44.

Activator component 42 comprises a protuberance or bead 58 which extends laterally from cable 34 to which it is connected, as by glue, etc. Bead 58 can be positioned a suitable distance on cable 34 away from blade 52.

Blade 52 faces, is in the path of travel of and is adapted to intercept activator component 42 (bead 58) as bowstring 38 is pulled back to a preselected full draw position. Bead 58 during such travel thus causes blade 52 to first flex laterally and then snap back and strike against tympanum 56, making a loud click to signal the archer to release the bowstring.

Accordingly, assembly 10 is fully adjustable as to full draw position, with drawcheck 14 causing no deflection of an arrow during shooting from bow 12. Moreover, casing 44 helps to guide cables 34 and 36. Drawcheck 14 is located in a sheltered position adjacent upper limb tip 32 and protected by upper limb 28 and cables 34 and 36, so it cannot snag or interfere with proper operation of bow 12. Drawcheck 14 is simple, inexpensive, durable and effective. It can be used on any conventional compound bow and is easy to install, relocate, adjust and remove. The clicker blade thereof cannot be snagged or misaligned or bent during use, storage or transportation. Due to the exactness of the criss-cross action of cables 34 and 36 in the area in which drawcheck 14 is installed, and the fact that casing 44 is anchored to cable 36, no essential variation in draw length will occur from shot to shot while using drawcheck 14. Moreover, if it becomes necessary, by accident or design, to fire the arrow before reaching full draw, no arrow damage will occur. If premature firing were to occur with a conventional drawcheck, the clicker blade thereof would strip or damage the arrow fletching and the shot will fall short and off line.

It will be understood that the improved bow assembly can employ a compound bow utilizing two, three, four or more pulleys, levers or the like, and that cables 34 and 36 could be separate lengths of an integrated cable.

FIG. 3.

Figure 3:
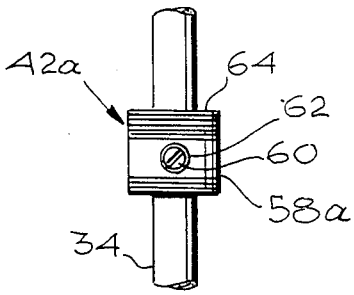
FIG. 3 is an enlarged schematic side elevation of a modified form of the activator component of the drawcheck of the present invention; and, FIG. 4 is an enlarged, schematic side elevation, partly broken away, of a modified form of the indicator portion of the drawcheck of the present invention.

A modified form of the activator portion of the drawcheck of the present invention is shown in FIG. 3. Thus, activator component **42*a* is shown. Portions thereof similar to those of component 42 bear the same numerals but are succeeded by the letter "a". Component 42*a* comprises block 58*a* fixable in place on cable 34 by a set screw 60 extending through a transverse opening 62 in block 58*a*. Block 58*a* has a vertical passageway (not shown) extending therethrough which passageway receives cable 34. The length and therefore the position of block 58*a* on cable 34 can be adjusted by set screw 60 to adjust the draw length necessary to effect clicking. Block 58*a* can also be made up of thin transverse layers 64 glued together and peelable from block 58*a* to also adjust finely the height of block 58*a*. Block 58*a* preferably is tubular and formed of many thin discs of paper, foil or plastic glued in stacked relation and is mounted by threading it on cable 34**.

FIG. 4.

Figure 4:
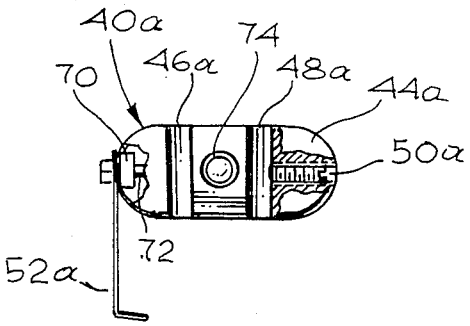

An alternate form of the indicator component of the drawcheck of the present invention is schematically depicted in FIG. 4. Thus, indicator component **40*a* is shown. Portions thereof similar to those of component 40 bear the same numerals but are succeeded by the letter "a". Component 40*a* includes a casing 44*a* having grooves 46*a* and 48*a* and a blade-like switch arm 52*a* depending from one side of casing 44*a*. Casing 44*a* is secured to cable 36 (not shown) by screw 50*a*. Switch arm 52*a* is connected to switch body 70 in casing 44*a*. Electrical conduits 72 extend through casing 44*a* and connect switch body 70 with a battery powered (by dry cell or the like) light 74 (lamp or L.E.D.) in casing 44*a*. Light 74 extends rearwardly therefrom for viewing by the archer during drawing of bowstring 38**.

In the resting position shown for arm **52*a* in FIG. 4, light 74 is off. However, when arm 52*a* is deflected laterally by contact with activator component 50 or 50*a*, light 74 goes on and the archer is signaled visually to fire the arrow. Thus, indicator 40*a* can be substituted for indicator 40**.

Various other modifications, changes, alterations and additions can be made in the improved compound bow assembly of the present invention, its components and parameters. All such modifications, changes, alterations and additions as are within the scope of the appended claims form part of the present invention.

What is claimed is:

1. An improved compound archery bow assembly with novel drawcheck, said assembly comprising, in combination:

a. a compound archery bow having
   i. a pair of spaced bow limbs at opposite ends thereof,
   ii. a handle with an arrow rest on one side thereof adapted to position an arrow horizontally relative to said bow, said handle inter-connecting said bow limbs,
   iii. pulleys connected to said limbs,
   iv. first and second pulley cables trained around said pulleys and spanning said bow and,
   v. a bowstring connected to said cables; and, b. an arrow drawcheck comprising
   i. an activator component comprising a protuberance extending from and connected only to said first cable in a position vertically displaced from said arrow rest and out of the path of said arrow, such that said activtor component moves with said first cable during drawing of said bowstring, and,
   ii. a drawcheck indicator component releasably connected only to said second cable adjacent said first cable and vertically displaced from said arrow rest and out of the path of said arrow, said indicator component being movable with said second cable and including flexible clicker blade which audibly clicks when it is temporarily flexed by said activator component during passage thereby and then allowed to snap against another portion of said indicator component to indicate a predetermined full draw position of said bowstring.

2. The improved archery bow assembly of claim 1 wherein said indicator component includes a tympanum positioned adjacent said blade and which audibly clicks when struck by said blade.

3. The improved archery bow assembly of claim 1 wherein said component comprises a cylinder anchored around said first cable and including peelable components for adjusting the length thereof.

4. The improved archery bow assembly of claim 1 wherein said indicator component comprises a casing having at least one cable guide groove in the exterior thereof, said casing bridging said two cables and being adjustably connected to said second cable, said casing bearing said clicker blade extending toward said activator component.

5. The improved archery bow assembly of claim 4 wherein said blade is adjustably secured to the outside of said casing connected to said second cable above said handle.

6. The improved archery bow assembly of claim 5 wherein said indicator component blade is adjustable in length and wherein both said indicator component and activator component are above said handle.

7. The improved archery bow assembly of claim 4 wherein said casing has a pair of said grooves slideably receiving said cables, wherein said casing is releasably and adjustably fixed to said second cable by a set screw, and wherein said indicator component includes a tympanum connected to said casing adjacent said blade, which tympanum audibly clicks when struck by said blade.

8. An improved compound archery bow assembly with novel drawcheck, said assembly comprising, in combination:

a. a compound archery bow having
   i. a pair of spaced bow limbs at opposite ends thereof,
   ii. a handle with an arrow rest on one side thereof adapted to position an arrow horizontally relative to said bow, said handle inter-connecting said bow limbs,
   iii. pulleys connected to said limbs,
   iv. first and second pulley cables trained around said pulleys and spanning said bow and,
   v. a bowstring connected to said cables; and,
b. an arrow drawcheck comprising
   i. an activator component comprising a protuberance extending from and connected only to said first cable in a position vertically displaced from said arrow rest and out of the path of said arrow, such that said activator component moves with said first cable during drawing of said bowstring, and,
   ii. a drawcheck indicator component releasably connected only to said second cable adjacent said first cable and vertically displaced from said arrow rest and out of the path of said arrow, said indicator component being movable with said second cable and including a switch arm extending from a casing connected to said second cable in the path of said protuberance, said casing including a switch, a battery powered light connected to the exterior of said casing and electrical conduits interconnecting said switch and light and activatable by contact with said activator component to indicate a predetermined full draw position of said bowstring.

* * * * *